United States Patent [19]

Elliott

[11] 4,331,450

[45] May 25, 1982

[54] COAL GASIFICATION PLANT SLAG TAPPING PROCESS

[75] Inventor: Richard P. Elliott, Kinross, Scotland

[73] Assignee: British Gas Corporation, London, England

[21] Appl. No.: 184,813

[22] Filed: Sep. 8, 1980

[51] Int. Cl.[3] ..... C10J 3/08

[52] U.S. Cl. ..... 48/210; 48/DIG. 2; 266/45; 266/89

[58] Field of Search ..... 48/210, DIG. 2, 197 R; 266/45, 89; 110/341

[56] References Cited

U.S. PATENT DOCUMENTS 4,078,903 3/1978 Eales ..... 48/DIG. 2

FOREIGN PATENT DOCUMENTS 977122 12/1964 United Kingdom .

*Primary Examiner*—Peter F. Kratz

*Attorney, Agent, or Firm*—Larson and Taylor

[57] ABSTRACT

An automatic arrangement in which the intermittent tapping of liquid molten slag from the hearth of a slagging coal gasifier vessel (30) through a tap orifice (32) into a slag quench chamber (31) is selectively controlled by a system of timers (T1, T2, T3), the differential pressure between the gasifier vessel (30) and the quench chamber (31) being measured (22) and deviations from the expected measurements caused by malfunctions being used to override the timer system until the malfunctions have been corrected.

1 Claim, 3 Drawing Figures

FROM T3

Figure 1:
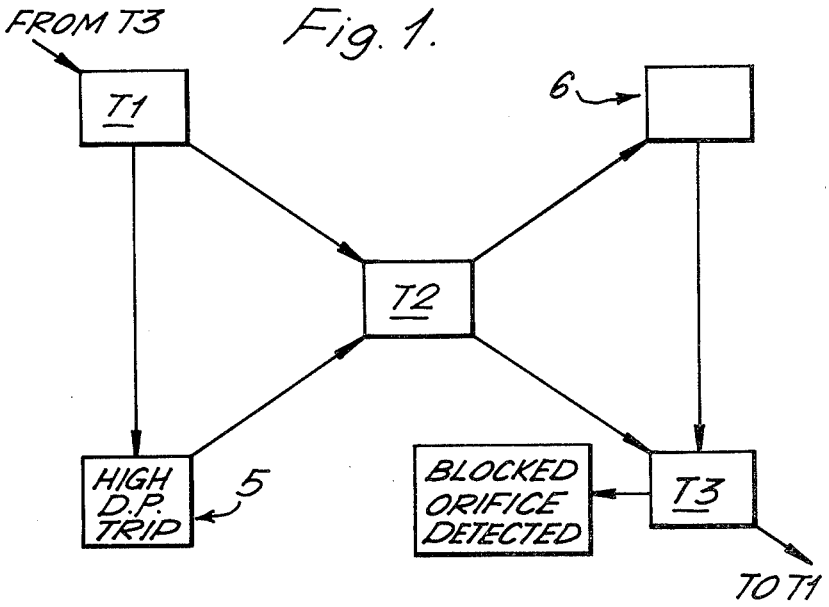

T1
6
T2
HIGH D.P. TRIP
5
BLOCKED ORIFICE DETECTED
T3
TO T1

T1, T2, T3
30
23
7
32
5
22
6
21
24
25
31
TO VENTING
27

21
19
20
28
26
16
15
14
17
18
AIR
OXYGEN
GAS
T1,T2,T3
8
9
10
13
12
11

COAL GASIFICATION PLANT SLAG TAPPING PROCESS

This invention relates to coal gasification plant, and in particular to a method of and apparatus for controlling the level of molten slag in the hearth of slagging coal gasifiers.

It is known to gasify coal or other carbonaceous fuel in slagging coal gasifiers of the kind (hereinafter referred to as the kind specified) in which coal or other carbonaceous fuel is introduced into the top of a column-like gasifying vessel and is gasified under high pressure and temperature by means of oxygen and steam introduced near the fuel bed through tuyeres. The residual ash collects as a molten slag and iron in the hearth of the gasifier vessel from which it is periodically discharged (commonly known as slag-tapping) downwardly through a slag tap outlet or orifice in the hearth into water contained in a quenching chamber. Usually, the pool of molten slag and iron is maintained in the hearth by directing hot combustion products from a burner located beneath the slag tap orifice up the tap orifice to retain the slag and iron in the hearth by maintaining a positive differential pressure between the quench chamber and the gasifying vessel, that is, a higher pressure in the quench chamber. The tapping of the molten slag and iron being initiated and controlled by stopping or reducing the burner output and reducing the pressure in the quenching chamber by controlled venting to atmosphere through a venting system so as to reduce the differential pressure between the quenching chamber and the gasifier vessel.

Examples of such slagging gasifier plant are those disclosed in United Kingdom patent specification No. 977,122, the Gas Council Research Communication No. GC 50 and GC 112.

The problems which the present Invention seeks to overcome are those experienced with known methods of slag level control in a vessel with continuous liquid flow at varying rate and intermittent outflow. The particular difficulties which the system overcomes are:

1. The lack of a consistent measurement of slag pool level.
2. The need to keep below the maximum permissible negative differential during taps. Above this differential, spraying occurs and the tap tends to block.
3. The need for rapid sensing and response to tap blockages to give quick clearance.
4. The need to avoid emptying the hearth, as this can cause a blocked tap.
5. The need for rapid system control if an irredeemably blocked tap is experienced.

According to the one aspect of the Invention, there is provided a method of controlling the level of molten slag in a slagging coal gasifier of the kind specified comprising the steps of, periodically tapping the slag from the hearth of the gasifier vessel through the slag tap orifice into the quench chamber using a system of timing means which set a maximum and a minimum predetermined period of time between slag tapping operations and which set the duration time of actual slag tapping, measuring the differential pressure between the gasifier vessel and the quench chamber whereby to give an indication of the level of slag in the hearth of the vessel and to cause initiation of a slag tapping operation when the slag reaches a predetermined level or when any deviations from the expected differential pressure measurements caused by malfunctions being detected and used to override the timer system until the malfunctions have been corrected.

According to another aspect of the Invention, there is provided an apparatus for carrying out the method described above comprising a system of timing means for setting said maximum and minimum periods and for setting the said slag tapping duration time, means for measuring said differential pressure and for producing a signal representative of said measurement, and means responsive to said signal for initiating a slag tapping operation when the slag reaches said predetermined level or when any said deviations from the expected differential pressure measurement is detected.

Figure 2:
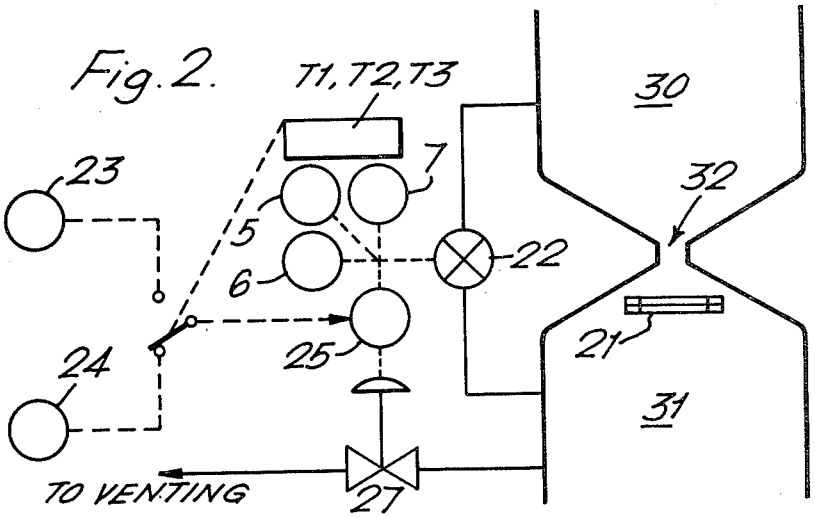
Figure 3:
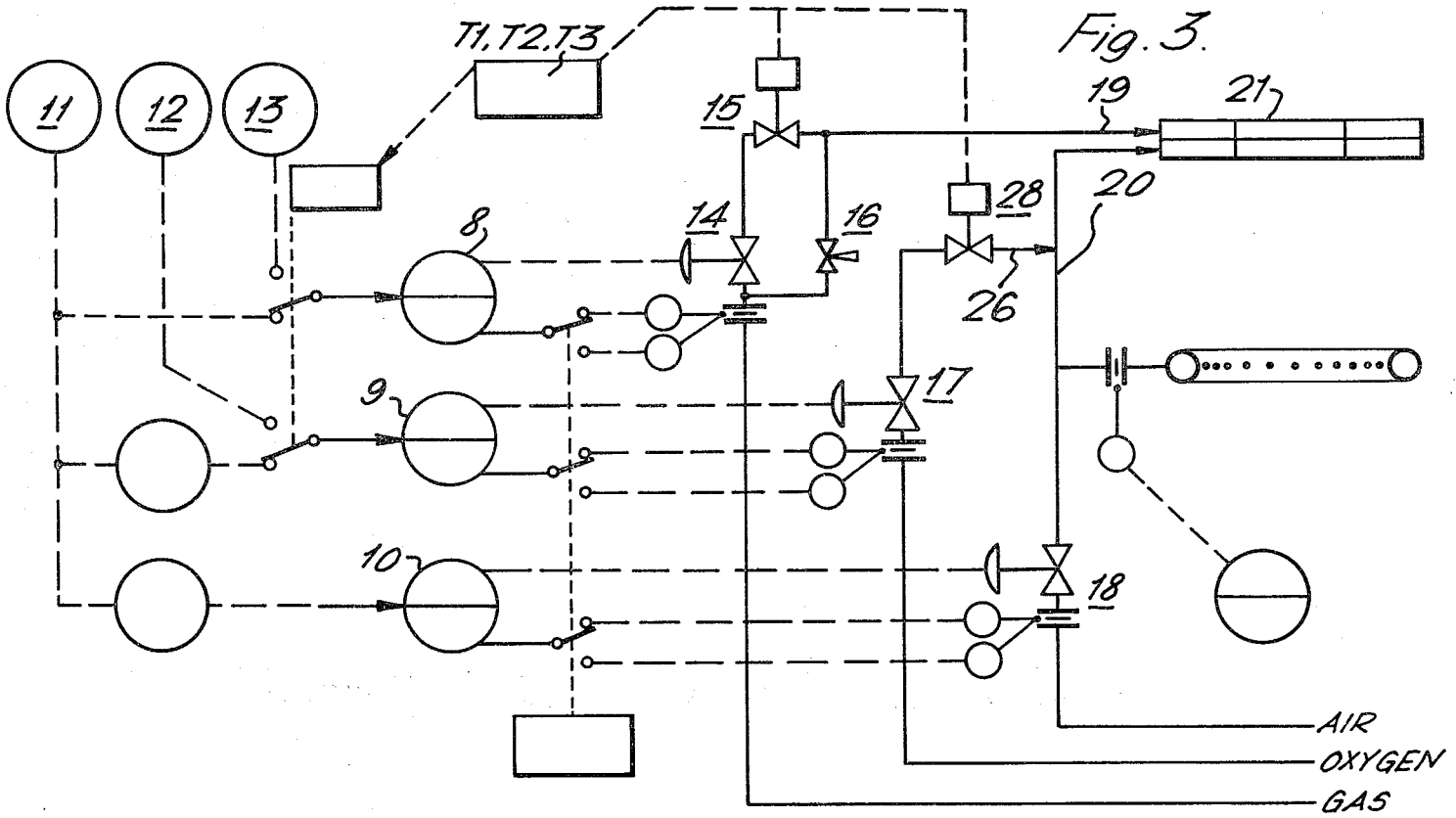

To enable the Invention to be more clearly understood, and solely by way of example, one embodiment of the Invention will now be described with reference to the accompanying drawings, in which:

FIG. 1 is a schematic flow diagram of the slag level control arrangement of timers and differential pressure trips, FIG. 2 is a schematic diagram showing an arrangement for measuring the differential pressure (and hence the slag level before tapping) and controlling the differential pressure, (and hence the slag flow rate) during a slag tapping operation in a slagging coal gasifier of the kind specified, and FIG. 3 is a schematic diagram showing how a burner rate is controlled.

Referring to the drawings, the invention relates to a system for controlling the level of molten slag in the hearth of a slagging coal gasifier of the kind specified, and for removing the slag at a fixed rate for a fixed period at intervals determined by the rate of slag build-up. The characteristics of the differential pressure between the gasifier vessel 30 (FIG. 2) and the quench chamber 31 are used as an indication of the molten slag level existing in the hearth. Hot burner gases from the burner 21 bubble up through the slag tap orifice 32 and through the head of molten slag in the hearth of the vessel 30, creating a differential pressure which is indicative of the slag level. The differential pressure is said to be positive when the quench chamber is at a higher pressure than the gasifier vessel.

Although the differential pressure can be used as a form of slag level measurement, it is envisaged that it is within the scope of the invention that any method of level measurement could be used, for example a radio active source.

During a slag-tapping operation the burner 21 located below the slag-tap orifice 32 is turned down to avoid any splattering or diffusion of the slag stream, and to avoid high temperature build-up in the quench chamber 31.

A slag-tapping operation is achieved in the gasifier by reducing the differential pressure between the quench chamber and the gasifier vessel. When this happens the quantity of slag, which previously had been held in the hearth and slag tap above the quench chamber by the positive differential pressure, runs through the slag tap orifice 32 into the quench chamber water (not shown) and is quenched and removed as frit through a removal means (not shown). The quench chamber pressure is lowered by a venting system, as described in UK patent specification No. 1,562,790. As explained eariler, the burner is turned down to a required burning rate to avoid any slag being diffused around the quench chamber and to avoid high temperature in the chamber.

With particular reference to FIG. 1, the system for obtaining an automatic slag-tapping operation to control the slag level in the hearth comprises three automatic timers, an enable period timer T1, a tap period timer T2 and a run period timer T3. The enable period timer T1 has a differential pressure override trip 5 which can over-ride the enable period timer period and start the tap period timer T2 to commence a slag tapping operation. The system is versatile and can be run in a number of ways according to the level of the slag in the hearth.

In a normal operation for a slag tap to take place the run timer T3, which is set to a minimum predetermined time between taps dependent upon the rate of slag production, is allowed to run out which then starts the enable time T1 to being its time period. The run period timer T3 re-sets to the pre-determined time. The end of the enable timer T1 period, or upon the operation of its high differential pressure trip 5, then starts the tap timer T2. The tap timer mechanism initiates the actuation of the valving means of the quench chamber venting system and a tap is completed at the end of the tap timer T2 period or upon the operation of its low differential pressure trip 6. The run timer T3 is then triggered so that the cycle can be repeated.

Referring also to FIG. 2 the low differential pressure trip 6 is activated during the tap period on the occurance of a blocked tap orifice to terminate the tapping operation. This would ensure a rise in quench chamber pressure due to re-establishment of the burner rate and closure of the venting valve means, with consequential clearing of the blocked orifice.

If the orifice becomes blocked during a run period, it will cause a rapid rise in pressure in the quench chamber and this high pressure is detected by a blocked-tap-orifice-detector 7. This automatically turns down the burner rate and initiates the actuation of the quench chamber venting valve means 27 to reduce the differential pressure to a safe level to enable an operator to take remedial action.

Referring also to FIG. 3, in a normal slag tapping cycle, the slag level in the hearth is rising during the run period controlled by the run timer T3. When the T3 timer period runs out, the enable timer T1 is started and if at any time during its timing period the high level differential pressure trip 5 is tripped, the timer T1 enables the trip 5 to initiate a tapping period, i.e. it starts timer T2. Should the high level differential pressure trip 5 not be tripped during the enable period, the tapping operation will begin at the end of the enable period. At the start of the tap period, in order to enable a tapping of the slag to take place, the burner rate is turned down and the quench chamber is vented to atmosphere in order to reduce the differential pressure for this purpose.

The rate of the burner 21 is turned down by reducing the gas and oxygen flows. The gas flow 19 through control valve 14 is closed by an automatic valve 15, but a sufficient amount of gas is fed to the burner via a needle valve 16 so as to maintain a small flame for relighting the burner. The oxygen flow 26 through the control valve 17 is cut off by an automatic valve 28. The set points of gas and oxygen flow controllers 8 and 9 respectively are switched from a burner-rate-manual-control 11 to manual slag tapping-rate-set-point-controls 12 and 13 which may be set to zero. The air flow through a control valve 18 remains constant and is controlled by controller 10, and its set point is derived from the manual control 11.

The differential pressure is measured by a detector 22 whose output signal is fed to the high and low differential pressure trips 5 and 6, the blocked tap detector 7 and the differential pressure controller 25. The output signal from controller 25 operates the valve 27 to achieve the differential pressure required by the controller's set point. During a slag tapping operation this set point is set by a pneumatic signal generator 23. During the run period this set point is set by a pneumatic signal generator 24 which is always set to a high differential to ensure that the valve 27 is closed.

If during a slag tapping operation a blocked slag orifice occurs giving rise to a momentary drop in differential pressure, this will be detected by trip 6 and the tapping will be terminated and the run period recommenced. This rapid re-establishment of the run condition will tend to blow the obstruction clear of the orifice.

If there is no interruption of tapping, the run period recommences after the tapping period is completed.

What we claim is:

1. A method for controlling the level of molten slag in a slagging coal gasifier comprising the steps of, periodically tapping the slag from the hearth of the gasifier vessel through a slag tap orifice into a quench chamber using a system of timing means which set a maximum and a minimum predetermined period of time between slag tapping operations and which set the duration time of actual slag tapping, measuring the differential pressure between the gasifier vessel and the quench chamber whereby to give an indication of the level of slag in the hearth of the vessel initiating a slag tapping operation after passage of the minimum predetermined period of time when the slag reaches a predetermined level as measured by the differential pressure, or initiating the slag tapping operation when any deviations from the expected differential pressure measurements caused by malfunctions are detected and used to override the timer system, said initiating of a slag tapping operation including turning down a burner which is located below the slag tap by decrease of fuel gas and oxygen flows to said burner and initiating the actuation of valving means of a venting system to vent the quench chamber.

* * * * *